US005422652A

United States Patent [19]

Caer et al.

[11] Patent Number: 5,422,652

[45] Date of Patent: Jun. 6, 1995

[54] WAVEGUIDE WITH NON-INCLINED RADIATING SLOTS EXCITED BY FLAT METAL PLATES

[75] Inventors: Daniel Caer, Limours; Jean Le Foll, Montlhery, both of France

[73] Assignee: Thomson-CSF, Puteaux, France

[21] Appl. No.: 991,374

[22] Filed: Dec. 15, 1992

[30] Foreign Application Priority Data

Dec. 31, 1991 [FR] France ..... 91 16384

[51] Int. Cl.[6] ..... H01Q 13/10

[52] U.S. Cl. ..... 343/771

[58] Field of Search ..... 343/767, 770, 771; H01Q 13/10

[56] References Cited

U.S. PATENT DOCUMENTS 2,574,433 11/1951 Clapp ..... 343/771
2,818,565 12/1957 Ajioka et al. ..... 343/767
3,004,259 10/1961 Shanks et al. ..... 343/771

FOREIGN PATENT DOCUMENTS 0048817 4/1982 European Pat. Off. .
0428299 5/1991 European Pat. Off. .
2654555 5/1991 France .

OTHER PUBLICATIONS

A. J. Sangster, "New Slotted-waveguide antenna element for low-side lobe arrays." *Int'l Jnl of Electronics*, vol. 68, No. 6, Jun. 1990, London, GB, pp. 1075-1088.

*Primary Examiner*—Michael C. Wimer
*Attorney, Agent, or Firm*—Roland Plottel

[57] ABSTRACT

In a waveguide (1) having slots (2, 3) perpendicular to the axis of the waveguide, cut out in a narrow wall of the waveguide, there are positioned, on each side of each slot, pairs of metal flat plates (21, 22; 31, 32) symmetrical with respect to the central axis of the slot. These flat plates modify the electrical field at the associated slot and make it possible to excite it, the value of the coupling being set by the adjusting of the size of the flat plates and of their position with respect to the corresponding radiating slot.

5 Claims, 1 Drawing Sheet

WAVEGUIDE WITH NON-INCLINED RADIATING SLOTS EXCITED BY FLAT METAL PLATES

BACKGROUND OF THE INVENTION

The present invention relates to a waveguide with non-inclined radiating slots of the type comprising slots perpendicular to the axis of the waveguide, cut out on a narrow wall of the waveguide with a spacing that is substantially but not precisely equal to a half wavelength of operation in the waveguide, and means for the excitation of each of the slots.

Slotted waveguides are often used as linear arrays of radiating sources in array antennas, for example in radar. Their advantages are low cost and low losses. To obtain radiation close to the normal to the waveguide, as well as efficient matching, it is necessary to have, firstly, a distance between successive slots that is close to $\lambda g/2$ where $\lambda g$ is the wavelength in the waveguide and, secondly, an additional phase shift of $\pi$ between two consecutive slots.

These conditions can be fulfilled with slots positioned on the broad wall of a rectangular-sectioned waveguide, or on its narrow wall. The arrangement with slots on the broad wall has several drawbacks, notably a substantial pitch between successive waveguides, which limits the scanning angle of the beam in a plane perpendicular to the waveguides. It is therefore preferred to use slots on the narrow wall of the waveguides.

If the slots are perpendicular to the axis of the waveguide, there is no energy coupling between the slots and the waveguide, and the radiation is zero.

In a first approach, therefore, the slots are inclined alternately on one side and then on the other, to obtain the necessary conditions specified here above. However, the drawback of this approach, resulting from the inclination of the slots, is that it entails the radiation of a crossed-polarization component which may reach levels incompatible with the efficient operation of the antenna using these waveguides.

Another known approach, therefore, consists in using slots that are not inclined (perpendicular to the axis of the waveguide) and exciting them by means of an obstacle positioned in the waveguide (iris, rods etc.).

In particular, the U.S. Pat. No. 4,435,715 (Hughes Aircraft) describes a waveguide with non-inclined slots in which the excitation of a slot is obtained by positioning conductive rods on either side of the slot. Each slot is positioned between an edge of the slot and one of the broad walls of the waveguide. However, the drawback of an approach such as this is that it is costly. Indeed, the rods have to be fixed individually inside the waveguide, for example by dip soldering. Furthermore, the use of rods entails major drawbacks as regards operations involving microwaves. For, this approach has a degree of frequency selectivity, the consequence of which is a restricted passband and a relatively unsatisfactory standing-wave ratio (SWR). Furthermore, the method of coupling by means of rods entails the use of relatively wide slots, resulting in a residual level of crossed polarization which may may raise problems for certain applications.

SUMMARY OF THE INVENTION

An object of the invention is a slotted waveguide that overcomes these drawbacks through the use of metal flat plates to excite each slot.

According to the invention, therefore, there is provided a waveguide with non-inclined radiating slots of the type comprising slots perpendicular to the axis of the waveguide, cut out on a narrow wall of the waveguide with a spacing that is substantially but not exactly equal to a half wavelength of operation in the waveguide, and means for the excitation of each of these slots, wherein said excitation means are constituted by at least one metal flat plate which is inserted in the waveguide along a broad wall of the waveguide and along said narrow wall bearing slots, in a position adjacent to the associated slot, and which extends in a plane parallel to that of the slot.

BRIEF DESCRIPTION OF THE DRAWINGS

The invention will be understood more clearly and other advantages will appear from the following description and from the appended drawings, wherein.

DESCRIPTION OF THE PREFERRED EMBODIMENTS

In the figures, the same elements are designated by the same reference numbers.

Figure 1:
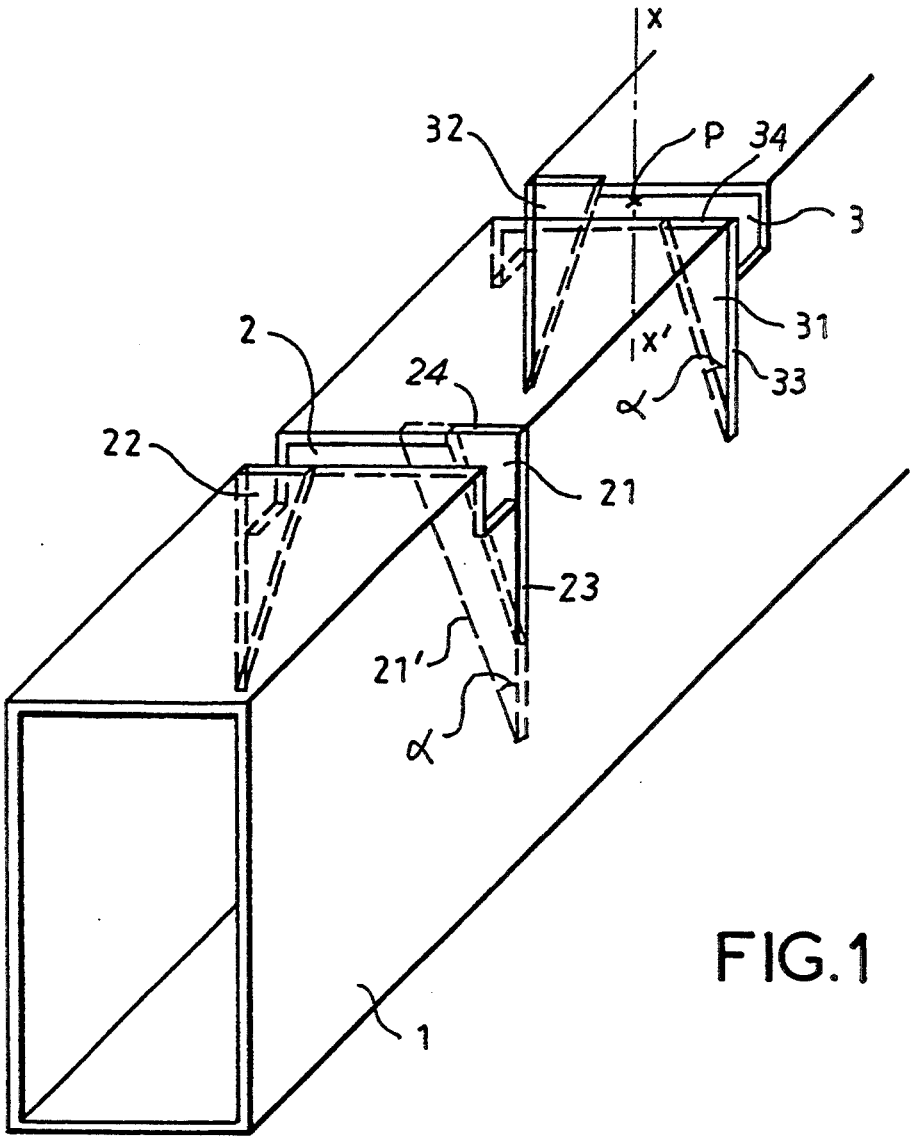
FIG. 1 shows a view in perspective of a slotted waveguide according to the invention.
Figure 2:
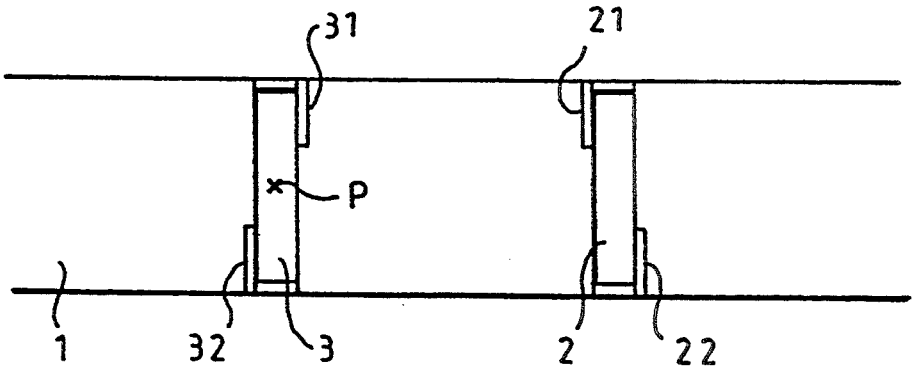
FIG. 2 shows the waveguide of FIG. 1, seen in a front view, on the radiating slots side.

FIGS. 1 and 2 show a waveguide 1 comprising radiating slots 2, 3 cut out of the narrow wall. These radiating slots are non-inclined, i.e. perpendicular to the longitudinal axis of the waveguide. As has already been mentioned, slots such as these are not normally coupled to the energy being propagated in the waveguide 1 and, therefore, do not radiate.

According to the invention, there is provision for inserting metal flat plates 21, 22, 31, 32 into the waveguide. These flat plates are triangular herein. They are placed and soldered in mounting slots cut out in the waveguide and having an appropriate depth, perpendicularly to the walls of the waveguide. The flat plates are associated with the slots 2, 3 in pairs, respectively 21–22, 31–32 and are positioned adjacently to the associated slots, on either side of these slots.

Each flat plate is located in the waveguide against the narrow wall bearing the slots and one of the broad walls of the waveguide.

The effect of these flat plates is to modify the electrical field at the level of the slot and hence to excite it.

The value of the coupling may be adjusted in two ways:

- by modifying the dimensions of the flat plates;
- by adjusting their position with respect to the radiating slot, i.e. by adjusting the distance of their plane with respect to the associated slot.

The radiating slots are spaced out with respect to one another by a pitch that is substantially equal to $\lambda g/2$, where $\lambda g$ is the wavelength of operation in the waveguide. The way in which this spacing will be chosen in practice shall be specified here below. Owing to this spacing, an additional phase-shift of $\pi$ has to be given between two consecutive radiating slots. This phase shift is obtained by reversing the positions of the flaps on either side of the slot in the consecutive pairs. Thus, in FIGS. 1 and 2, the position of the flat plates 31 and 32 is reversed with respect to that of the flat plates 21 and 22. The flat plates associated with a slot 31, 32, for example, are symmetrical with respect to the central axis XX' of the slot, namely the axis normal to the narrow wall of the waveguide bearing the slots going through the center P of the slot.

Preferably, the metal flat plates are all cut out to form rectangular triangles that are similar irrespectively of their size and therefore have the same angle $\alpha$. This has been symbolized in FIG. 1 where dashes are used to represent a larger-sized flat plate 21' having the same angle $\alpha$. The advantage of a characteristic such as this is that, during manufacture, all the slots, such as 23, 24 or 33, 34, for the mounting of the flat plates may be obtained by orienting the waveguide by a rotation about its axis by a given fixed angle with respect to the machining tool.

The angle $\alpha$ is chosen to obtain optimum matching in the waveguide and may, for example, be of the order of 30°. An advantage of the use of flat plates is that it is possible to have a small-sized flat plate for a weak coupling and that, at the same time, it is possible to have a simple and mechanically precise and reliable assembly.

As can be seen, the metal flat plates constitute obstacles in the waveguide and necessarily produce reflections of a part of the energy that gets propagated therein. It is clear that, when the spacing between homologous flat plates is equal to $\lambda$ g/2, the reflected energies get added and this results in major deterioration of the SWR. When the operation has to be done in a given frequency band, therefore, it is necessary to design the waveguide with a spacing between radiating slots such that either this spacing is smaller than $\lambda$ g/2 for all the frequencies of the band or else it is greater than $\lambda$ g/2 for all the frequencies of the band. In practice, the former approach is preferred for, when the spacing is greater than $\lambda$ g/2, there is a risk that troublesome array lobes might appear.

As indicated further above, the coupling of a radiating slot is adjustable by the size of the flat plates and by their spacing at the slot. One of the great advantages of the metal flat plates is that they can all be positioned on the edge of the radiating slots (unlike the rods) and that it is in this position that the widest passband is obtained.

Naturally, in the case of an array comprising a substantial number of slots, it is hardly possible to envisage the industrial-scale manufacture of as many sizes of flat plates as there are slots in a waveguide. Thus, a given number of different sizes is determined for the flat plates and the adjusting of the couplings is completed by modifying the spacings between flat plates and corresponding slots. This compromise makes it possible to keep a sufficiently wide passband and, at the same time, results in optimized manufacture.

From the electrical viewpoint in operations involving microwaves, metal flat plates are less selective than is the case, for example, with rods or irises. A wider passband and a better SWR are thus obtained. However a major advantage is that, in addition, it has been observed that, with metal flat plates as excitation devices, the radiating slots used could be be far narrower, up to 50% narrower. Now, this is essential for the performance characteristics of a rectilinear polarization antenna using slotted waveguides such as these, for the result thereof is a notable decrease in the crossed polarization.

Naturally, the exemplary embodiments described in no way restrict the scope of the invention. In particular, it is possible to use only one excitation flat plates per slot (for example the flat plates 21 and 32 or 22 and 31) although the performance characteristics are slightly less promising. Similarly, the shape of the flat plates is not a matter of critical importance and rectangular or rounded flat plates, for example, could also be used.

What is claimed is:

1. A slot waveguide having a rectangular section with two narrow walls and two broad walls, and comprising:

a plurality of slots cut into one of said narrow walls perpendicularly to said broad walls, the spacing between two successive slots being near to one-half wavelength of operation in the waveguide and and so that, for a given band of operating frequencies of said waveguide, said spacing is outside a range of lengths defined by the half wavelengths corresponding to all said operating frequencies; and a plurality of flat metal plates in said waveguide in contact with a broad wall of said waveguide and with said one narrow wall, at least one of said metal plates being in said waveguide in a position adjacent to each one of said slots and extending in a plane parallel to the plane containing said each one slot and perpendicular to said broad walls.

2. A slot waveguide according to claim 1, wherein two of said flat metal plates are associated with each of said slots, said two metal plates being symmetrical with respect to a central axis of the associated slot passing through the center of said slot and perpendicular to the narrow walls of said waveguide, the relative positioning of said two metal plates with respect to said associated slot being reversed from one slot to the next one.

3. A slot waveguide according to anyone of claims 1 or 2, wherein said flat metal plates are triangular in shape.

4. A slot waveguide according to claim 1, wherein the size of said flat metal plates inside the waveguide is determined by the coupling to be achieved between the wave propagated in said waveguide and the associated slot and wherein said plates all have the shape of similar triangles.

5. A slot waveguide according to claim 4, wherein said waveguides comprises mounting slots, each cut out both in a broad wall and said one narrow wall in a plane perpendicular to the walls of the waveguide, to enable insertion of said flat metal plates in said waveguide.

* * * * *